US006802639B2

(12) United States Patent
Kozyuk

(10) Patent No.: US 6,802,639 B2
(45) Date of Patent: Oct. 12, 2004

(54) HOMOGENIZATION DEVICE AND METHOD OF USING SAME

(75) Inventor: Oleg V. Kozyuk, Westlake, OH (US)

(73) Assignee: Five Star Technologies, Inc., Cleveland, OH (US)

( * ) Notice: Subject to any disclaimer, the term of this patent is extended or adjusted under 35 U.S.C. 154(b) by 26 days.

(21) Appl. No.: 10/271,611

(22) Filed: Oct. 15, 2002

(65) Prior Publication Data

US 2004/0071044 A1 Apr. 15, 2004

(51) Int. Cl.[7] ..... B01F 5/08
(52) U.S. Cl. ..... 366/176.2
(58) Field of Search ..... 366/176.1, 176.2; 137/625.38, 625.37; 138/46, 45, 44

(56) References Cited

U.S. PATENT DOCUMENTS 3,776,278 A * 12/1973 Allen ..... 137/625.38
4,081,863 A 3/1978 Rees
4,127,332 A 11/1978 Thiruvengadam et al.
4,135,829 A 1/1979 Grillo et al.
4,479,509 A * 10/1984 Dear et al. ..... 137/625.37
4,506,991 A 3/1985 Hudson
4,585,357 A 4/1986 Ogata
4,610,548 A 9/1986 Hallet et al.
4,671,321 A * 6/1987 Paetzel et al. ..... 138/43
5,232,726 A 8/1993 Clark et al.
5,492,654 A * 2/1996 Kozjuk et al. ..... 366/336
5,723,518 A 3/1998 Kahl et al.
6,106,145 A 8/2000 Winslow
6,502,979 B1 * 1/2003 Kozyuk ..... 366/176.2

* cited by examiner

*Primary Examiner*—Tony G. Soohoo
(74) *Attorney, Agent, or Firm*—Benesch Friedlander Coplan & Aronoff LLP

(57) ABSTRACT

A homogenization device comprising a flow-through channel having at least two local constrictions of flow wherein the size of a first local constrictions is adjustable thereby permitting variable flow rate through one portion of the device and the size of a second local constriction is fixed thereby permitting constant flow rate through another portion of the device.

28 Claims, 6 Drawing Sheets

HOMOGENIZATION DEVICE AND METHOD OF USING SAME

BACKGROUND OF THE INVENTION

The present invention relates in general to a homogenization device and more particularly to an homogenization device having an adjustable orifice and even more particularly to a homogenization device having an adjustable orifice for homogenization of a multi-component stream, having a liquid component and a substantially insoluble component that may be either a liquid or a finely divided solid.

In accordance with U.S. Pat. No. 4,127,332, there is disclosed a homogenization apparatus which provides an emulsion or colloidal suspension having an extremely long separation half-life by the use of cavitating flow. The prior art homogenization apparatus is constructed of a generally cylindrical conduit including an orifice plate assembly extending transversely thereacross and having an orifice opening provided therein. The orifice opening is described as embodying various designs such as circular blunt or sharp edged, square sharp edged and, a pair of substantially semi-circular annular segments. The homogenization process is effected by passing a multicomponent stream, including a liquid and at least one insoluble component, into a cavitating turbulent velocity shear layer created by the orifice opening through which the stream flows with a high velocity. The cavitating turbulent shear layer provides a flow regime in which vapor bubbles form, expand, contract and ultimately collapse. By subsequently exposing the turbulent shear layer to a sufficient high downstream pressure, the bubbles collapse violently and cause extremely high pressure shocks which cause intermittent intermixing of the multicomponent stream. As a result, a homogenized effluent of liquid and the insoluble component is generated which has a substantially improved separation half-life.

In accordance with the prior art homogenization apparatus, it is generally known that the effective intermixing of the multicomponent stream is dependent upon a number of factors, for example, upstream pressure, downstream pressure, conduit diameter, orifice diameter, etc. The most critical factor effecting the homogenizing quality and efficiency is generally considered to be the orifice diameter. U.S. Pat. Nos. 4,506,991 and 4,081,863 disclose emulsifier and homogenization devices having adjustable orifices to permit the operator to change and control the overall homogenizing quality and efficiency.

SUMMARY OF INVENTION

One aspect of the present invention to provide an adjustable orifice assembly for use in a homogenization device which overcomes or avoids one or more of the foregoing disadvantages resulting from the use of the above-mentioned prior art emulsification and homogenization devices for the intermixing of a multi-component stream.

A further aspect of the present invention is to provide a homogenization device having an adjustable orifice for homogenizing a liquid and a substantially insoluble component by generating a cavitating flow regime in a turbulent velocity shear layer.

A still further aspect of the present invention is to provide a homogenization device having an adjustable orifice for homogenizing a multi-component stream to produce an intermixing of a dispersed component and a continuous component.

A yet still further aspect of the present invention is to provide a homogenization device having an adjustable orifice for providing a controlled orifice length in an inexpensive and readily adjustable manner.

A yet still further aspect of the present invention is to provide a homogenization device having an adjustable orifice that permits an operator to adjust the length of the orifice to change the flow rate through the device, while maintaining the homogenizing quality and efficiency.

One embodiment according to the present invention provides a homogenization device comprising a flow-through channel having at least two local constrictions of flow wherein the size of one of the local constrictions is adjustable thereby permitting variable flow rate through one portion of the device, while the size of a second local constriction is fixed thereby permitting constant flow rate through another portion of the device. A baffle element is disposed in the flow-through channel and movable axially therein along the length of the orifice. The flow-through channel includes an orifice disposed therein having a length that is parallel to the axis of the flow-through channel. The first local constriction is created between the orifice disposed in the flow-through channel and the baffle element, while the second local constriction is created between by the space between the baffle element and the inner surface of the flow-through channel. Accordingly, the flow rate of fluid through the first local constriction is variable, while the flow rate of fluid through the second local constriction is constant regardless of the axial movement and subsequent positioning of the baffle element within flow-through channel.

Another embodiment according to the present invention provides a homogenizer device comprising a housing having an inlet opening for introducing fluid into the device, an outlet opening for exiting fluid from the device, and a flow-through channel in fluid communication with the inlet opening. The flow-through channel has a longitudinal axis and is defined by at least one wall where the at least one wall has a first orifice disposed therein to provide fluid communication between the flow-through channel and the outlet opening. Preferably, the first orifice has an upstream end and a downstream end defining a length therebetween that is parallel to the longitudinal axis of the flow-through channel. A baffle element is also disposed within the flow-through channel between the upstream end and downstream end thereby defining a second orifice between the perimeter of the baffle element and the at least one wall. The baffle element also defines an effective length of the first orifice defined as the axial distance between the upstream end of the first orifice and the baffle element. The baffle element is also movable within the flow-through channel between the upstream end and the downstream end of the first orifice to change the effective length of the first orifice thereby adjusting the flow rate of fluid through the orifice while maintaining the flow rate of fluid through the second orifice.

In one embodiment, the first orifice may be a longitudinal slot having a width and a length parallel to the longitudinal axis of the flow-through channel. Optionally, the at least wall includes a plurality of longitudinal slots disposed therein to provide fluid communication between the flow-through channel and the outlet opening. Preferably, the at least one wall is a cylindrical wall and the baffle element is either conically shaped or disc shaped. In this case, the second orifice is an annular orifice defined between the cylindrical wall of the flow-through channel and the perimeter of the baffle element having a conically-shaped or disc-shaped surface.

In an another embodiment according to the present invention, a homogenizer device comprises a housing having an outlet opening for exiting fluid from the device and an internal chamber in fluid communication with the outlet opening. The device also comprises a flow-through channel disposed within the internal chamber wherein the flow-through channel has a longitudinal axis and an inlet opening for introducing fluid into the flow-through channel. The flow-through channel is defined by a cylindrical wall that has a slot disposed therein to provide fluid communication between the flow-through channel and the internal chamber. The slot has an upstream end and a downstream end defining a length therebetween wherein the length of the slot is parallel to the longitudinal axis of the flow-through channel. The device further comprises a baffle element that is coaxially disposed within the flow-through channel between the upstream end and the downstream end of the slot thereby defining an annular orifice between the perimeter of the baffle element and the cylindrical wall. The position of the baffle element within the flow-through channel also defines an effective length of the slot that is defined as the axial distance between the upstream end of the slot and the baffle element. The baffle element is movable within the flow-through channel between the upstream end and the downstream end of the slot to change the effective length of the slot thereby adjusting the flow rate of fluid through the slot while maintaining the flow rate of fluid through the annular orifice.

Optionally, the device may include a second housing having a second internal chamber in fluid communication with the outlet opening and with the inlet opening of the flow-through channel and a second flow-through channel disposed within the second internal chamber. The second flow-through channel has a longitudinal axis and an inlet opening for introducing fluid into the flow-through channel. The second flow-through channel is defined by a cylindrical wall that has a second slot disposed therein to provide fluid communication between the second flow-through channel and the second internal chamber. The second slot has an upstream end and a downstream end defining a length therebetween wherein the length of the second slot is parallel to the longitudinal axis of the second flow-through channel. The device further includes a second baffle element coaxially disposed within the second flow-through channel between the upstream end and the downstream end of the second slot thereby defining a second annular orifice between the perimeter of the second baffle element and the cylindrical wall of the second flow-through channel. The position of the baffle element within the flow-through channel defines an effective length of the second slot wherein the effective length of the second slot is defined as the axial distance between the upstream end of the second slot and the second baffle element. The second baffle element is movable within the second flow-through channel between the upstream end and the downstream end of the second slot to change the effective length of the second slot thereby adjusting the flow rate of fluid through the second slot while maintaining the flow rate of fluid through the second annular orifice.

BRIEF DESCRIPTION OF THE DRAWINGS

The above description, as well as further objects, features and advantages of the present invention will be more fully understood by reference to the following detailed description of a presently preferred, but nonetheless illustrative, homogenization device having an adjustable orifice in accordance with the present invention when taken in conjunction with the accompanying drawings, wherein.

DETAILED DESCRIPTION OF INVENTION

Figure 1:
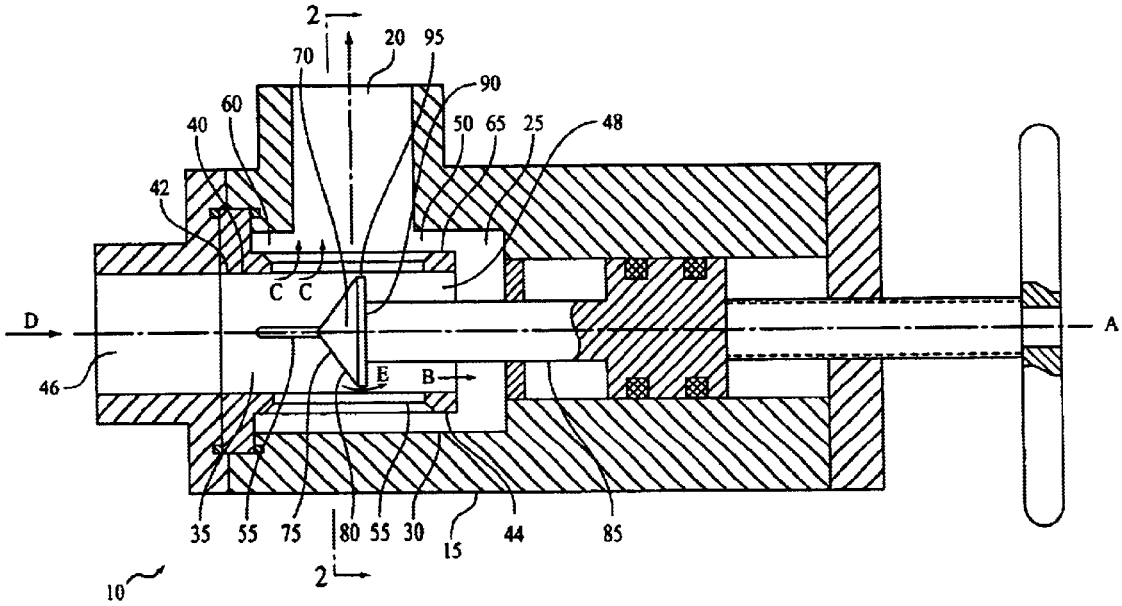
FIG. 1 is a cross-sectional view taken along a longitudinal section of a homogenization device 10 according to the present invention.

In accordance with this invention, and as shown in FIG. 1, a homogenization device 10 according to the present invention comprises a housing 15 having an outlet opening 20 for exiting fluid and dispersants from device 10 and an internal cylindrical chamber 25 (hereinafter referred to as "internal chamber 25") defined by an inner cylindrical surface 30. Internal cylindrical chamber 25 has a longitudinal axis A and is in fluid communication with outlet opening 20. Although it is preferred that the cross-section of internal chamber 25 is circular, the cross-section of internal chamber 25 may take the form of any geometric shape such as square, rectangular, or hexagonal and still be within the scope of the present invention.

Figure 2:
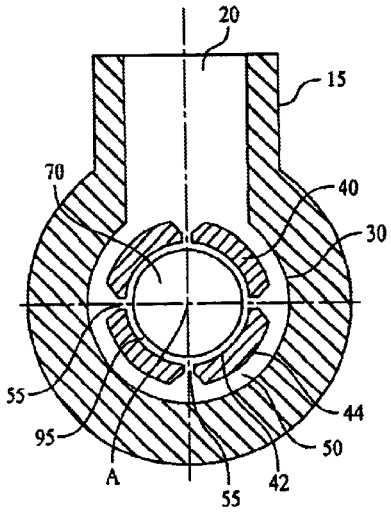
FIG. 2 is a cross-sectional view taken along section A—A of device 10 illustrated in FIG. 1.
Figure 3:
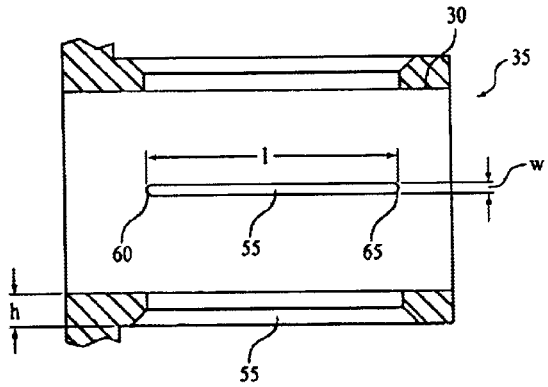
FIG. 3 is a cross-sectional view of flow-through channel 35 defined by cylindrical wall 40 having longitudinal slots 55 provided therein.

Device 10 further comprises a flow-through channel 35 defined by a cylindrical wall 40 having an inner surface 42, an outer surface 44, an inlet opening 46 for introducing fluid into device 10, and an outlet opening 48. Although it is preferred that the cross-section of flow-through channel 35 is circular, the cross-section of flow-through channel 35 may take the form of any geometric shape such as square, rectangular, or hexagonal and still be within the scope of the present invention. Flow-through channel 35 is coaxially disposed within internal chamber 25 thereby forming an annular space 50 between inner surface 42 of internal chamber 25 and outer surface 44 of flow-through channel 35. Outlet opening 60 in flow-through channel 35 permits fluid communication between flow-through channel 35 and internal chamber 25 as indicated by arrow B. Cylindrical wall 40 includes a plurality of orifices, each taking the shape of a longitudinal slot 55, provided therein to permit fluid communication between flow-through channel 35 and internal chamber 25 as indicated by arrows C. Each longitudinal slot 55 has an upstream end 60 and a downstream end 65 defining a length (l) therebetween that is parallel to the direction of fluid flow, a width (w), and a height (h) as shown in FIG. 3. Although FIGS. 1 and 2 illustrate four longitudinal slots 55 provided in cylindrical wall 40, it is apparent that any number of slots 55 less than or greater than four may be suitable for the present invention. Further, although the preferred embodiment includes longitudinal slots, one skilled in the art would appreciate that orifices taking on other shapes (e.g., elliptical, rectangular, square, or any other geometric shape) are within the scope of the present invention.

It is important to note that each of the three dimensions of longitudinal slot 55, either alone or in combination with each other, impact a particular function of device 10. The width of longitudinal slot 55, indicated by dimensional arrows "w" as shown in FIG. 3, determines the homogenizing quality and efficiency of device 10. The height of longitudinal slot 55, indicated by dimensional arrows "h" as shown in FIG. 3, determines the product travel distance and thus defines the time interval during which energy is released. The length of longitudinal slot 55, indicated by dimensional arrows "l" as shown in FIG. 3, determines the flow rate of fluid through slot 55. Therefore, by adjusting the length of longitudinal slot 55, the flow rate of device 10 may be changed. Accordingly, to adjust the flow rate of device 10 while maintaining the homogenizing quality and efficiency of device 10, the length (l) of slot 55 needs to be adjustable, while the width (w) of slot 55 needs to be maintained.

To accomplish the tasks of adjusting the length (l) of slot each 55 and maintaining the width (w) of each slot 55, device 10 includes a baffle element 70 coaxially disposed within flow-through channel 35 and movable axially within flow-through channel 35 between upstream end 60 and downstream end 65 of slot 55. Preferably, baffle element 70 includes a conically-shaped surface 75 wherein the tapered portion 80 of conically-shaped surface 75 confronts the fluid flow and a rod 85 is secured to a base portion 90 of baffle element 70. Rod 85 is slidably mounted to housing 15 and is capable of being locked in a position by any locking means know in the art such as a threaded nut or collar (not shown). Rod 85 is connected to a mechanism (not shown) for axial movement of rod 85 relative to housing 15. Such mechanism may be powered by a pneumatic, electric, mechanical, electro-mechanical, or electro-magnetic power source.

Figure 4A:
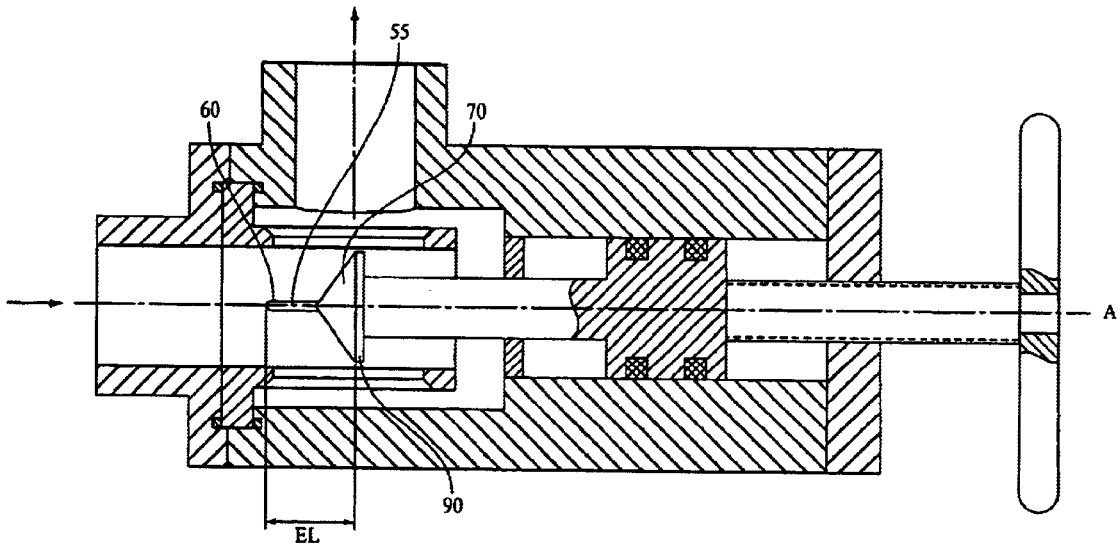
FIG. 4A illustrates the effective length (EL) of the homogenization device 10 according to the present invention.

Baffle element 70 directs a portion of fluid through the effective length of each slot 55. The term "effective length" used herein refers to the axial distance between upstream end 60 of each longitudinal slot 55 and the base portion 90 of baffle element 70 as indicated by the dimensional arrows "EL" shown in FIG. 4A. Since baffle element 70 is movable within flow-through channel 35 between upstream end 60 and downstream end 65 of each slot 55, the effective length of each slot 55 may be changed thereby adjusting the flow rate of fluid through each slot 55. Therefore, the flow rate of fluid through each longitudinal slot 55 is adjustable depending on the axial position of baffle element 70. Although the effective length of longitudinal slot 55 is adjustable by axially moving baffle element 70, the width (w) of slot 55 stays the same. Therefore, the homogenizing quality and efficiency of device 10 stays the same and is not affected by the change in flow rate through each slot 55. Further, the passing of a portion of fluid through each slot 55 may generate a hydrodynamic cavitation field downstream from each slot 55 which further assists in the homogenization process.

Baffle element 70 is also capable of homogenizing fluid and generating a hydrodynamic cavitation field downstream from baffle element 70 via annular orifice 95. Annular orifice 95 is defined as the distance between inner surface 42 of flow-through channel 35 and the perimeter of the base portion 90 of baffle element 70. However, since annular orifice 95 maintains the same distance between inner surface 42 of flow-through channel 35 and the perimeter of the base portion 90 of baffle element 70 regardless of where baffle element 70 is moved within flow-through channel 35, the flow rate of fluid through annular orifice 95 is constant. Although annular orifice 95 is ring-shaped because of the circular cross-section of baffle element 70 and the circular cross-section of cylindrical wall 40, one skilled in the art would understand that if the cross-section of flow-through channel 35 is any other geometric shape other than circular, then the orifice defined between the wall forming flow-through channel 35 and baffle element 70 may not be annular in shape but is within the scope of the present invention. Likewise, if baffle element 70 is not of circular cross-section, then the orifice defined between the wall forming flow-through channel 35 and baffle element 70 may not be annular in shape but is within the scope of the present invention.

Figure 4B:
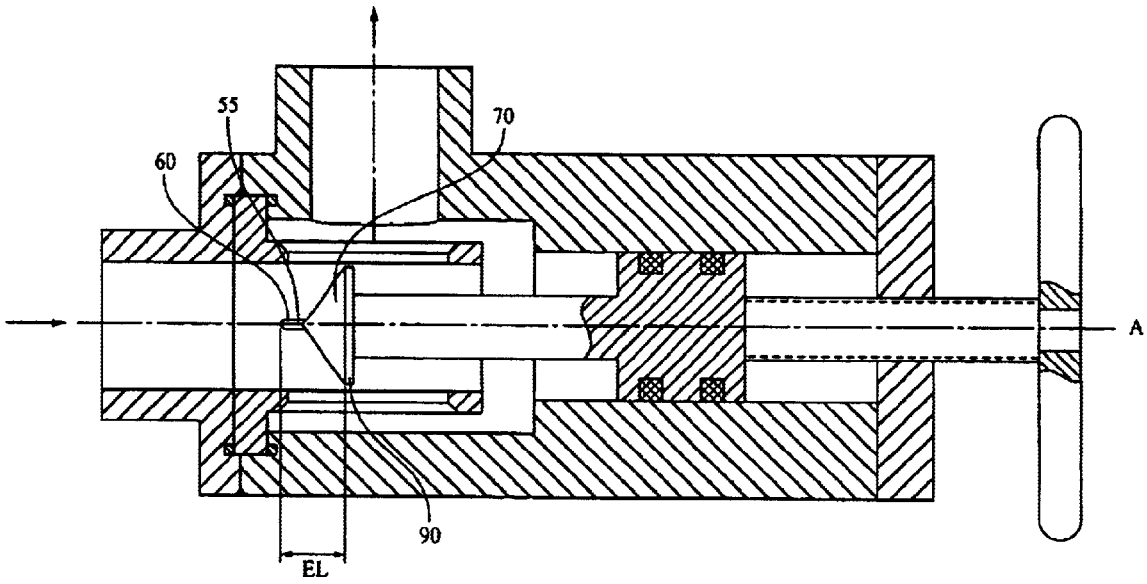
FIG. 4B illustrates the effective length (EL) of the homogenization device 10 according to the present invention after baffle element 70 is moved axially upstream to decrease the flow rate through the device 10.
Figure 4C:
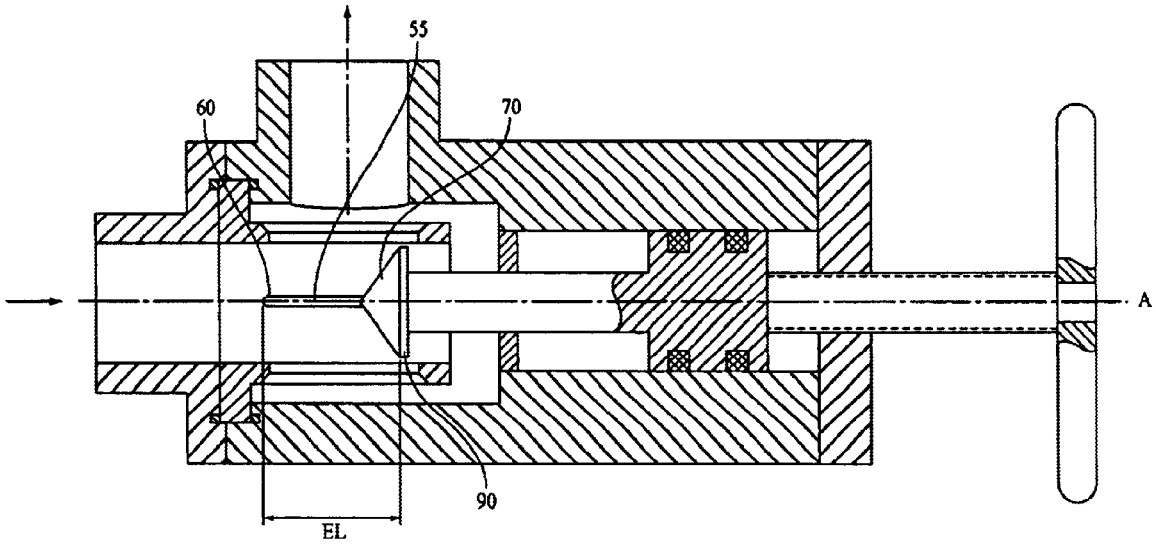
FIG. 4C illustrates the effective length (EL) of the homogenization device 10 according to the present invention after baffle element 70 is moved axially downstream to increase the flow rate through the device 10.

To decrease the flow rate of fluid through each slot 55 and ultimately device 10, baffle element 70 is moved axially upstream thereby decreasing the effective length of longitudinal slot 55 as indicated by the dimensional arrows "EL" shown in FIG. 4B. In one extreme example, if the effective length of each slot 55 is equal to 0, then fluid is prevented from passing through each slot 55 and all of the fluid passes through annular orifice 95 at a minimum flow rate. In this example, the flow rate through device 10 is at its minimum level because of the absence of fluid flow through slots 55. To increase the flow rate of fluid through each slot 55 and ultimately device 10, baffle element 70 is moved axially downstream thereby increasing the effective length of longitudinal slot 55 as indicated by the dimensional arrows "EL" shown in FIG. 4C. In an opposite extreme example, if the effective length of each slot 55 is equal to the length (l) of each slot 55, then a portion of fluid passes through each slot 55 and the remaining portion of fluid passes through annular orifice 95. In this example, the flow rate through device 10 is at its maximum level because the fluid is permitted to flow through the entire length (l) of each slot 55 and through annular orifice 95.

To further promote the creation and control of cavitation fields downstream from baffle element 70, baffle element 70 is constructed to be removable and replaceable by any baffle element having a variety of shapes and configurations to generate varied hydrodynamic cavitation fields. The shape and configuration of baffle element 70 can significantly effect the character of the cavitation flow and, correspondingly, the quality of dispersing. Although there are an infinite variety of shapes and configurations that can be utilized within the scope of this invention, U.S. Pat. No. 5,969,207, issued on Oct. 19, 1999, discloses several acceptable baffle element shapes and configurations, and U.S. Pat. No. 5,969,207 is hereby incorporated by reference in its entirety herein.

It is understood that baffle element 70 can be removably mounted to rod 85 in any acceptable fashion. However, the preferred embodiment utilizes a baffle element that threadedly engages rod 85. Therefore, in order to change the shape and configuration of baffle element 70, rod 85 must be removed from device 10 and the original baffle element unscrewed from rod 85 and replaced by a different baffle element which is threadedly engaged to rod 85 and replaced within device 10.

In the operation of device 10, a multi-component stream, having a liquid component and an insoluble component, is introduced into inlet opening 46 of device 10 at a relatively low velocity, but at a relatively high pressure generated by a pump (not shown) upstream from device 10. The multi-component stream moves along arrow D through the inlet opening 46 and enters flow-through channel 35 where the multi-component stream encounters baffle element 70. A portion of the multi-component stream is directed by baffle element 70 through the effective length of each longitudinal slot 55 creating a local constriction of flow. The local constriction forces the portion of the multi-component stream into internal chamber 25 at a high velocity as indicated by arrows C in FIG. 1. As the multi-component stream is forced through the local constriction defined by the effective length (EL), width (w), and height (h) of each slot 55, the multi-component stream is homogenized into a homogenized liquid caused by the energy release in the passageway and the hydrodynamic cavitation field created downstream from each slot 55. The homogenizing quality and efficiency of the homogenized liquid depends on the width (w) of each slot 55, while the flow rate of the multi-component stream through device 10 depends on the effective length (EL) of each slot 55. The homogenized liquid exits device 10 via outlet opening 20.

Due to the surface area controlled by baffle element 70 within flow-through channel 35, the remaining portion of the multi-component stream is forced to pass between annular orifice 95 creating another local constriction, indicated by arrow E in FIG. 1, created between the outer diameter of the base portion 90 of baffle element 70 and inner surface 42 of flow-through channel 35. By constricting the multi-component stream flow in this manner, the hydrostatic fluid pressure is increased upstream from annular orifice 95. As the remaining portion of the high pressure multi-component stream flows through annular orifice 95 and past baffle element 70, the remaining portion of the multi-component stream is homogenized caused by energy release as the remaining portion of the multi-component stream passes through annular orifice 95. Further, a low pressure cavity is formed downstream from baffle element 70 which promotes the formation of cavitation bubbles. As the cavitation bubbles enter the increased pressure zone upstream past baffle element 70, a coordinated collapsing of the cavitation bubbles occurs in a cavitation field, accompanied by high local pressure and temperature, as well as by other physio-chemical effects which initiate the progress of mixing, emulsification, homogenization, or dispersion. The resulting cavitation field, having a vortex structure, makes it possible for processing the liquid and insoluble components of the multi-component stream in flow-through channel 35 downstream from baffle element 70. The processed multi-component stream exits flow-through channel 35 via outlet opening 48, enters internal chamber 25, and exits device 10 via outlet opening 20.

If the operator desires to decrease the flow rate of the multi-component stream through device 10, the operator may move baffle element 70 axially upstream to decrease the effective length of each slot 55. The operator may then lock rod 85 in place and introduce the multi-component stream into inlet opening 46 to begin the homogenization process described above. If the operator desires to increase the flow rate of the multi-component stream through device 10, the operator may move baffle element 70 axially downstream to decrease the effective length of each slot 55. The operator may then lock rod 85 in place and introduce the multi-component stream into inlet opening 46 to begin the homogenization process described above. Once again, although the flow rate may be increased or decreased due to the adjustment of the effective length (EL) of each slot 55, the homogenizing quality and efficiency stays the same because the width (w) of each slot 55 is maintained.

Figure 5:
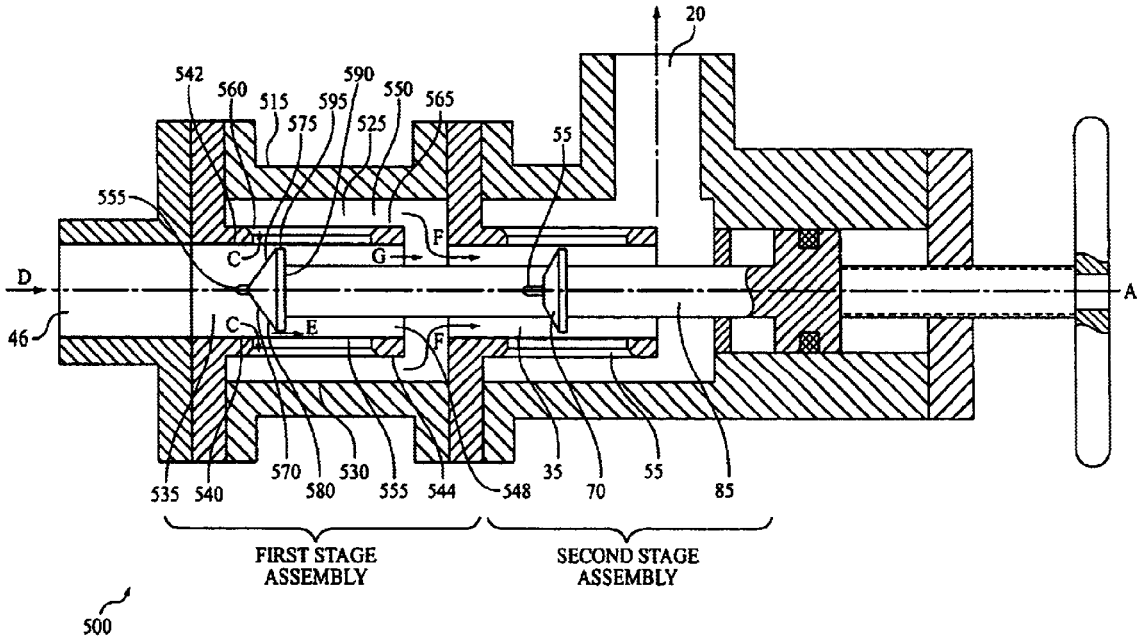
FIG. 5 is a cross-sectional view taken along a longitudinal section of an alternative embodiment of a homogenization device 500 according to the present invention.

In alternative embodiment according to the present invention, FIG. 5 illustrates a two-stage homogenization device 500 as opposed to the single stage homogenization device 10 described above and shown in FIGS. 1 and 2. Homogenization device 500 essentially includes two homogenization devices 10 arranged in series, while sharing the same rod 85 and having only a single inlet opening 46 and outlet opening 20. Although device 500 includes a single rod 85 controlling the axial movement of the baffle elements, it is contemplated that a second rod may be provided to permit independent movement of each baffle element. Accordingly, homogenization device 500 comprises a second housing 515 having an internal cylindrical chamber 525 (hereinafter referred to as "internal chamber 525") defined by an inner cylindrical surface 530. Internal cylindrical chamber 525 shares longitudinal axis A and is in fluid communication with inlet opening 42 of the second stage assembly. Although it is preferred that internal chamber 525 is cylindrical shaped, internal chamber 525 may take the form of any shape such as square, rectangular, or hexagonal and still be within the scope of the present invention. Further, although homogenization device 500 includes two stages, it is apparent that more than two stages may be utilized and is within the scope of the present invention.

Device 500 further comprises a second flow-through channel 535 defined by a cylindrical wall 540 having an inner surface 542, an outer surface 544, an inlet opening 546 for introducing fluid into device 500, and an outlet opening 548. Although it is preferred that flow-through channel 535 is cylindrically shaped, flow-through channel 535 may take the form of any shape such as square, rectangular, or hexagonal and still be within the scope of the present invention. Flow-through channel 535 is coaxially disposed within internal chamber 525 thereby forming an annular space 550 between inner surface 542 of internal chamber 525 and outer surface 544 of flow-through channel 535. Outlet opening 560 in flow-through channel 535 permits fluid communication between flow-through channel 535 and internal chamber 525 as indicated by arrow B. Cylindrical wall 540 includes a plurality of orifices, each taking the shape of a longitudinal slot 555, provided therein to permit fluid communication between flow-through channel 535 and internal chamber 525 as indicated by arrows C. Each longitudinal slot 555 has an upstream end 560 and a downstream end 565 defining a length (l) therebetween that is parallel to the direction of fluid flow, a width (w), and a height (h) as shown in FIG. 3. Although FIG. 5 illustrates four longitudinal slots 55 provided in cylindrical wall 40, it is apparent that any number of slots 55 less than or greater than four may be suitable for the present invention. Further, although the preferred embodiment includes longitudinal slots, one skilled in the art would appreciate that orifices taking on other shapes (e.g., elliptical, rectangular, square, or any other geometric shape) are within the scope of the present invention.

Device 500 includes a second baffle element 570 coaxially disposed within flow-through channel 535 and movable axially within flow-through channel 535 between upstream end 560 and downstream end 565 of slot 555. Preferably, baffle element 570 includes a conically-shaped surface 575 wherein the tapered portion 580 of conically-shaped surface 575 confronts the fluid flow and rod 85 is secured to a base portion 590 of baffle element 570. Baffle element 570 directs a portion of fluid through the effective length of each slot 555. Therefore, baffle element 570 is movable within flow-through channel 535 between upstream end 560 and downstream end 565 of each slot 555 to adjust the effective length of each longitudinal slot 555 thereby effecting the flow rate of fluid through each slot 555. Although the effective length of longitudinal slot 55 is adjustable by axially moving baffle element 70, the width (w) of slot 75 always stays the same. Accordingly, the homogenizing quality and efficiency of device 10 always stays the same and is not affected by the change in flow rate through each slot 555. Further, the passing of a portion of fluid through each slot 555 generates a hydrodynamic cavitation field downstream from each slot 555 which further assists in the homogenization process.

Baffle element 570 is also capable of homogenizing fluid and generating a hydrodynamic cavitation field downstream from baffle element 570 via annular orifice 595 defined as the distance between inner surface 542 of flow-through channel 535 and the perimeter of the base portion 590 of baffle element 570. However, since annular orifice 595 maintains the same distance between inner surface 542 of flow-through channel 535 and the perimeter of the base portion 590 of baffle element 570 regardless of where baffle element 70 is positioned within flow-through channel 535, the flow rate of fluid through annular orifice 595 is constant.

In the operation of device 500, a multi-component stream, having a liquid component and an insoluble component, is introduced into inlet opening 546 of device 500 at a relatively low velocity, but at a relatively high pressure generated by a pump (not shown) upstream from device 500. The multi-component stream moves along arrow D through the inlet opening 546 and enters flow-through channel 535 where the multi-component stream encounters baffle element 570. A portion of the multi-component stream is directed by baffle element 570 through the effective length of each longitudinal slot 555 creating a local constriction of flow. The local constriction forces the portion of the multi-component stream into internal chamber 525 at a high velocity as indicated by arrows C in FIG. 5. As the multi-component stream is forced through the passageway defined by the effective length (EL), width (w), and height (h) of each slot 555, the multi-component stream is homogenized into a homogenized liquid caused by the energy release in the passageway and the hydrodynamic cavitation field created downstream from each slot 555. The homogenizing quality and efficiency of the homogenized liquid depends on the width (w) of each slot 555, while the flow rate of the multi-component stream through device 500 depends on the effective length (EL) of each slot 555. The homogenized liquid exits the first stage assembly of device 500 via internal chamber 525 and enters the flow-through channel 35 of the second stage assembly of device 500 as indicated by arrows F. The operation through the second stage assembly of device 500 is the same as described above.

Due to the surface area controlled by baffle element 570 within flow-through channel 535, the remaining portion of the multi-component stream is forced to pass between annular orifice 595 creating another local constriction, indicated by arrow E in FIG. 5, created between the outer diameter of the base portion 590 of baffle element 570 and inner surface 42 of flow-through channel 535. By constricting the multi-component stream flow in this manner, the hydrostatic fluid pressure is increased upstream from annular orifice 595. As the high pressure multi-component stream flows through annular orifice 595 and past baffle element 570, the remaining portion of the multi-component stream is homogenized caused by energy release as the remaining portion of the multi-component stream passes through annular orifice 595. Further, a low pressure cavity is formed downstream from baffle element 570 which promotes the formation of cavitation bubbles. As the cavitation bubbles enter the increased pressure zone upstream past baffle element 570, a coordinated collapsing of the cavitation bubbles occurs in a cavitation field, accompanied by high local pressure and temperature, as well as by other physio-chemical effects which initiate the progress of mixing, emulsification, homogenization, or dispersion. The resulting cavitation field, having a vortex structure, makes it possible for processing the liquid and insoluble components of the multi-component stream in flow-through channel 535 downstream from baffle element 570. The processed multi-component stream exits flow-through channel 535 via outlet opening 548, enters and exits internal chamber 525, and enters flow-through channel 535 of the second stage assembly of device 500 as indicated by arrow G. The operation through the second stage assembly of device 500 is the same as described above.

If the operator desires to decrease the flow rate of the multi-component stream through device 500, the operator may move baffle elements 70, 570 axially upstream to decrease the effective length of each slot 55, 555. The operator may then lock rod 85 in place and introduce the multi-component stream into inlet opening 546 to begin the homogenization process described above. If the operator desires to increase the flow rate of the multi-component stream through device 500, the operator may move baffle elements 70, 570 axially downstream to decrease the effective length of slot 55, 555. The operator may then lock rod 85 in place and introduce the multi-component stream into inlet opening 546 to begin the homogenization process described above. Once again, although the flow rate may be increased or decreased due to the adjustment of the effective length of each slot 55, 555, the homogenizing quality and efficiency stays the same because the width (w) of each slot 55, 555 is maintained.

Regarding all embodiments described above, one skilled in the art would appreciate and recognize that the housing may be of unitary construction or may be constructed from a multiple number of parts to form such housing. Further, the inlet opening 46 and outlet opening 20 may or may not be directly provided in the housing.

While this invention has been described with an emphasis upon a preferred embodiment, it will be obvious to those of ordinary skill in the art that variations of the preferred embodiment may be used and that it is intended that the invention may be practiced otherwise than as specifically described herein. Other features and aspects of this invention will be appreciated by those skilled in the art upon reading and comprehending this disclosure. Such features, aspects, and expected variations and modifications of the reported results and are clearly within the scope of the invention where the invention is limited solely by the scope of the following claims.

Having thus defined the invention, I claim:

1. A homogenizer device comprising:

a housing having:

an inlet opening for introducing fluid into said device, an outlet opening for exiting fluid from said device, and a flow-through channel in fluid communication with said inlet opening, said flow-through channel having a longitudinal axis and being defined by at least one wall, said at least one wall having a first orifice disposed therein to provide fluid communication between said flow-through channel and said outlet opening, said first orifice having an upstream end and a downstream end defining a length therebetween that is parallel to said longitudinal axis of said flow-through channel; and a baffle element disposed within said flow-through channel between said upstream end and said downstream end thereby defining a second orifice between the perimeter of said baffle element and said at least one wall, said baffle element also defining an effective length of said first orifice defined as the axial distance between said upstream end of said first orifice and said baffle element, said baffle element being movable within said flow-through channel between said upstream end and said downstream end of said first orifice to change said effective length of said first orifice thereby adjusting the flow rate of fluid through said first orifice while maintaining the flow rate of fluid through said second orifice.

2. The device of claim 1, wherein said first orifice is a longitudinal slot having a width and a length parallel to said longitudinal axis of said flow-through channel.

3. The device of claim 2, wherein said at least wall includes a plurality of longitudinal slots disposed therein to provide fluid communication between said flow-through channel and said outlet opening.

4. The device of claim 2, wherein said width of said longitudinal slot is maintained at the same dimension after said effective length of said slot is changed thereby maintaining the homogenizing quality and efficiency of said device.

5. The device of claim 1, wherein said at least one wall is a cylindrical wall.

6. The device of claim 5, wherein said baffle element comprises a conically-shaped surface wherein the tapered portion of said conically-shaped surface confronts the fluid flow, a rod secured to the opposite end of said tapered portion of said conically-shaped surface and installed coaxially in the flow-through channel for axial displacement of said conically-shaped surface in relation to the flow-through channel.

7. The device of claim 6, wherein said second orifice is an annular orifice defined between said cylindrical wall of said flow-through channel and the perimeter of said baffle element having a conically-shaped surface.

8. The device of claim 1, wherein said first orifice creates a first local constriction of flow that is capable of generating a hydrodynamic cavitation field downstream from said first orifice.

9. The device of claim 1, wherein said second orifice creates a second local constriction of flow that is capable of generating a hydrodynamic cavitation field downstream from said baffle element.

10. The device of claim 1, wherein a portion of fluid is directed through said effective length of said first orifice by said baffle element while the remaining portion of fluid passes through said second orifice.

11. A homogenizer device comprising:

a housing having an outlet opening for exiting fluid from said device and an internal chamber in fluid communication with said outlet opening;

a flow-through channel disposed within said internal chamber, said flow-through channel being defined by a cylindrical wall that has a slot disposed therein to provide fluid communication between said flow-through channel and said internal chamber, said slot having an upstream end and a downstream end defining a length therebetween, said flow-through channel having an inlet opening for introducing fluid into said flow-through channel and a longitudinal axis, said length of said slot being parallel to said longitudinal axis of said flow-through channel, and a baffle element coaxially disposed within said flow-through channel between said upstream end and said downstream end of said slot thereby defining an annular orifice between the perimeter of said baffle element and said cylindrical wall and defining an effective length of said slot, said effective length of said slot being defined as the axial distance between said upstream end of said slot and said baffle element, said baffle element being movable within said flow-through channel between said upstream end and said downstream end of said slot to change said effective length of said slot thereby adjusting the flow rate of fluid through said slot while maintaining the flow rate of fluid through said annular orifice.

12. The device of claim 11, wherein said cylindrical wall has a plurality of slots disposed therein to provide fluid communication between said flow-through channel and said internal chamber.

13. The device of claim 11, wherein said baffle element comprises a conically-shaped surface wherein the tapered portion of said conically-shaped surface confronts the fluid flow, a rod secured to the opposite end of said tapered portion of said conically-shaped surface and installed coaxially in the flow-through chamber for axial displacement of said conically-shaped surface in relation to the flow-through channel.

14. The device of claim 11, wherein said internal chamber is cylindrically shaped sharing the same longitudinal axis of said flow-through channel.

15. The device of claim 11, wherein said flow-through channel has an outlet opening in fluid communication with said internal chamber.

16. The device of claim 11, wherein a portion of fluid is directed through said effective length of said slot by said baffle element when said effective length of slot is greater than zero while the remaining portion of fluid passes through said annular orifice.

17. The device of claim 11, further comprising:

a second housing having a second internal chamber in fluid communication with said outlet opening with said inlet opening of said flow-through channel;

a second flow-through channel disposed within said second internal chamber, said second flow-through channel being defined by a cylindrical wall that has a second slot disposed therein to provide fluid communication between said second flow-through channel and said second internal chamber, said second slot having an upstream end and a downstream end defining a length therebetween, said second flow-through channel having an inlet opening for introducing fluid into said flow-through channel and a longitudinal axis, said length of said second slot being parallel to said longitudinal axis of said second flow-through channel; and a second baffle element coaxially disposed within said second flow-through channel between said upstream end and said downstream end of said second slot thereby defining a second annular orifice between the perimeter of said second baffle element and said cylindrical wall of said second flow-through channel and defining an effective length of said second slot, said effective length of said second slot being defined as the axial distance between said upstream end of said second slot and said second baffle element, said second baffle element being movable within said second flow-through channel between said upstream end and said downstream end of said second slot to change said effective length of said second slot thereby adjusting the flow rate of fluid through said second slot while maintaining the flow rate of fluid through said second annular orifice.

18. The device of claim 17, wherein said second cylindrical wall has a plurality of slots disposed therein to provide fluid communication between said second flow-through channel and said second internal chamber.

19. The device of claim 17, wherein said second baffle element comprises a conically-shaped surface wherein the tapered portion of said conically-shaped surface confronts the fluid flow, a rod secured to the opposite end of said tapered portion of said conically-shaped surface and installed coaxially in the flow-through chamber for axial displacement of said conically-shaped surface in relation to the second flow-through channel.

20. The device of claim 17, wherein said second internal chamber is cylindrically shaped sharing the same longitudinal axis of said second flow-through channel.

21. The device of claim 17, wherein a portion of fluid is directed through said effective length of said second slot by said second baffle element when said effective length of slot is greater than zero while the remaining portion of fluid passes through said second annular orifice.

22. A device for homogenizing a fluid, the device comprising:

a flow-through channel having at least two local constrictions of flow wherein:

the size of a first local constriction is adjustable thereby permitting a portion of the fluid to flow through the first local constriction at a variable flow rate and, the size of a second local constriction is fixed thereby permitting a remaining portion of the fluid to flow through the second local constriction at a constant flow rate.

23. A method for homogenizing fluid comprising:

providing a device that includes a flow-through channel defined by a cylindrical wall wherein said cylindrical wall has a longitudinal slot disposed therein to provide fluid communication between said flow-through channel and an outlet opening, said slot having an upstream end and a downstream end defining a length therebetween that is parallel to said longitudinal axis of said flow-through channel;

providing a baffle element disposed within said flow-through channel between said upstream end and a downstream end thereby defining an annular orifice between the perimeter of said baffle element and said cylindrical wall and defining an effective length of said slot between said upstream end of said slot and said baffle element; and passing fluid through said flow-through channel towards said baffle element such that fluid is capable of passing through said annular orifice and said slot depending on the axial position of said baffle element, said baffle element being movable within said flow-through channel between said upstream end and said downstream end of said slot to change said effective length of said slot thereby adjusting the flow rate of fluid through said slot while maintaining the flow rate of fluid through said annular orifice.

24. The method of claim 23, wherein said baffle element directs a portion of fluid through said effective length of said slot to homogenize said portion of fluid when said effective length is greater than zero while the remaining portion of fluid passes through said annular orifice to homogenize said remaining portion of fluid.

25. The method of claim 23, further comprising the step of:

moving said baffle element axially upstream to decrease said effective length of said slot thereby decreasing the flow rate of fluid through said device.

26. The method of claim 23, further comprising the step of:

moving said baffle element axially downstream to increase said effective length of said slot thereby increasing the flow rate of fluid through said device.

27. The method of claim 23, wherein said cylindrical wall further comprises a plurality of longitudinal slots provided therein to provide fluid communication between said flow-through channel and said outlet opening, each longitudinal slot having an upstream end and a downstream end defining a length therebetween that is parallel to said longitudinal axis of said flow-through channel.

28. A method for homogenizing a fluid, the method comprising:

passing a portion of the fluid through an adjustable local constriction and a remaining portion of the fluid through a fixed local constriction wherein the flow rate of the portion of the fluid passing through said adjustable local constriction is variable, while the flow rate of the remaining portion of the fluid passing through said fixed local constriction is constant.

* * * * *